US006196471B1

(12) United States Patent
Ruthenberg

(10) Patent No.: US 6,196,471 B1
(45) Date of Patent: Mar. 6, 2001

(54) APPARATUS FOR CREATING A MULTI-COLORED ILLUMINATED WATERFALL OR WATER FOUNTAIN

(76) Inventor: Douglas Ruthenberg, 10453 Tillery Rd., Spring Hill, FL (US) 34608

( * ) Notice: Subject to any disclaimer, the term of this patent is extended or adjusted under 35 U.S.C. 154(b) by 0 days.

(21) Appl. No.: 09/451,335

(22) Filed: Nov. 30, 1999

(51) Int. Cl.[7] ..... F21S 8/00
(52) U.S. Cl. ..... 239/18
(58) Field of Search ..... 239/589, 590, 239/592, 593, 597, 18; 362/96, 294

(56) References Cited

U.S. PATENT DOCUMENTS

| | | | | |
|---|---|---|---|---|
| 1,454,150 | * | 5/1923 | Brockmiller | 239/18 |
| 3,702,172 | * | 11/1972 | Hawkins | 239/18 |
| 3,866,832 | * | 2/1975 | Noguchi | 239/18 |
| 4,581,687 | | 4/1986 | Nakanishi | 362/226 |
| 4,749,126 | * | 6/1988 | Kessener et al. | 239/12 |
| 4,975,811 | | 12/1990 | Fraser et al. | 362/96 |
| 5,171,429 | | 12/1992 | Yasuo | 210/94 |
| 5,249,744 | | 10/1993 | Ruthenberg | 239/23 |
| 5,890,794 | * | 4/1999 | Abtahi et al. | 362/294 |
| 5,893,179 | | 4/1999 | Johnson | 4/507 |
| 5,927,845 | | 7/1999 | Gustafson et al. | 362/152 |

* cited by examiner

*Primary Examiner*—Andres Kashnikow
*Assistant Examiner*—Davis Hwu
(74) *Attorney, Agent, or Firm*—Dennis G. LaPointe; Mason & Associates, PA

(57) ABSTRACT

An apparatus for creating a multi-colored illuminated waterfall includes a waterfall vessel, a clear tube disposed within the vessel, LED bulbs mounted on a circuit board strip which is disposed within the clear tube and a controller circuit which sequentially activates predetermined arrays of different colored LED bulbs. The waterfall vessel has baffles for suppressing turbulence and optional reflective film for enhancing emitted light. A controller circuit is included to sequentially light predetermined arrays of different colored LED bulbs. A rectifier circuit is included to convert a 12 volt ac circuit to a 12 volt dc circuit and a transformer reduces a 110 volt ac power source to a 12 volt ac supply. In an embodiment for a water fountain, the circuit board strip with the LED bulbs are instead disposed within a branch of a tee with a clear lens separating the LED bulbs from the water flow portion of the tee. Water flows into a second branch of the tee and out the third branch of the tee through a discharge tube with a swivel connection at the third branch of the tee to direct the discharge tube through an aperture in a facade. The third branch of the tee includes longitudinal baffles for suppressing turbulence and an optional laminate of reflective film to enhance emitted light.

16 Claims, 9 Drawing Sheets

APPARATUS FOR CREATING A MULTI-COLORED ILLUMINATED WATERFALL OR WATER FOUNTAIN

BACKGROUND OF THE INVENTION

1. Field of the Invention

The invention relates to an apparatus for creating an illuminated waterfall.

2. Description of Related Art

Lighted water displays are very popular and generally known in the art. For example, illuminated water fountains are provided by means of light sources which are generally hidden from view and are projected onto a waterfall. However, the quality of the visual effects of such lighted displays, especially multi-colored displays, is diminished due to indirect lighting which impairs the view of the lighted waterfall. For example, U.S. Pat. No. 4,975,811 to Fraser et al. depicts a conical reflector to illuminate and create rainbows in a wall of falling water.

The above-related prior art do not provide a combination of a waterfall device with emitting and enhancing lighting means incorporating light emitting diode (LED) technology inside a waterfall vessel to illuminate the non-turbulent stream of water exiting the vessel to form an illuminated waterfall. Further, the present invention provides an apparatus which can sequentially change the color displayed. One prior art patent, U.S. Pat. No. 5,171,429 to Yasuo, depicts an apparatus using combined LED technology, fiber optics, and sensors in a water discharge system wherein the water is illuminated by an LED whose color changes in accordance with values sensed by a sensor in the water stream. However, this prior art patent does not provide for an array of different color LED lights within the waterfall vessel which is controlled to sequentially light and thereby sequentially illuminate the water exiting a waterfall vessel with different colors so as to give the exiting water the appearance of changing colors at periodic intervals.

SUMMARY OF THE INVENTION

The present invention is an apparatus for creating a multi-colored illuminated waterfall. The apparatus includes means for changing a columnar flow of incoming water from a water inlet pipe into a shallow stream of water having a predetermined breadth greater than the breadth of the inlet pipe so that a waterfall effect is created. The waterfall vessel has a first end and a second end, each end having apertures therethrough axially aligned with each other.

A clear tube having a first end and a second end is longitudinally disposed between the first end aperture and the second end aperture of the waterfall vessel. The first and second ends of the tube are in leak tight engagement at the first end aperture and the second end aperture respectively.

An LED light emitting circuit board wafer strip with a plurality of different colored LED bulbs mounted to the wafer strip in a predetermined spaced-apart arrangement, is disposed through the first end aperture and inside the clear tube. A controller circuit is in electrically operative communication with predetermined arrays of the plurality of different colored LED bulbs wherein the predetermine arrays of the plurality of different colored LED bulbs activate at predetermined sequences and at predetermined time intervals.

The means for creating the waterfall effect is a waterfall vessel having a top wall, a bottom wall, a front wall and the first and second ends. It has an inlet opening for incoming columnar water flow into the vessel, an outlet opening for water flow exiting in the form of a waterfall, and at least one baffle disposed in the vessel for suppressing turbulence of the incoming columnar water flow. An alternative embodiment for a waterfall vessel includes a plurality of longitudinally disposed baffles in the vessel for suppressing turbulence of the incoming columnar water flow, including baffles which intersect or interconnect with each other. These interconnecting baffles have a plurality of apertures for directing the flow of water from the inlet opening, through the baffles, to the outlet opening and for suppressing water turbulence.

An additional feature includes means for reflecting and enhancing emitted light. Preferably, the means include a reflective film adhesively secured to portions of inside surfaces of the baffles, front wall, back wall, and bottom wall juxtaposed to the clear tube.

A controller circuit supplies electrical power to the arrays of the plurality of different colored LED bulbs. The controller circuit includes a rectifier circuit for converting a 12 volt-ac source circuit to a 12 volt-dc circuit, which in turn supplies the electrical power to the arrays of the plurality of different colored LED bulbs.

In circuits where only 110volts-ac is available, a transformer circuit for reducing a voltage from the 110 volt-ac source circuit to a 12 volts-ac circuit is provided. The 12 volts-ac circuit is in electrically operative communication with the rectifier circuit.

In another embodiment of the invention, the present invention is an apparatus for creating a multi-colored illuminated water fountain such as those found in pools or fountain areas where water is discharge through an opening in a facade, for example, the mouth of a facade depicting the face of a lion.

The apparatus includes means for changing a columnar flow of incoming water from a water inlet pipe into a laminar stream of water to create a water fountain effect. The means includes a tee in fluid communication with the water inlet pipe. The tee has a first branch, a second branch and a third branch. The tee first branch further includes a clear lens disposed inside the first branch, the lens being in a leak tight engagement with an inside surface of the first branch.

The second branch is in fluid communication with the water inlet pipe and the third branch is in fluid communication with a tubular directing means for creating the laminar stream of water and for directing the water flow in a desired direction through an opening in a facade.

An LED light emitting circuit board wafer strip includes a plurality of different colored LED bulbs in a predetermined spaced-apart arrangement. The circuit board wafer strip is disposed juxtaposed the clear lens inside the first branch of the tee. A controller circuit is in electrically operative communication with the predetermined arrays of the plurality of different colored LED bulbs wherein the predetermine arrays of the plurality of different colored LED bulbs activate at predetermined sequences and at predetermined time intervals.

The tubular directing means for creating the laminar stream of water includes a plurality of longitudinal baffles disposed within the third branch of the tee. The baffles extend radially from a central axis of the third branch of the tee and interconnect with each other at the central axis. The baffles provide turbulence suppression of the incoming columnar flow of water. The tubular directing means also includes a discharge tube with a ball-type swivel connection at one end of the discharge tube for mechanically connecting the discharge tube to the third branch of the tee.

The apparatus optionally includes means for reflecting and enhancing emitted light with the use of a reflective film adhesively secured to portions of inside surfaces of the plurality of longitudinal baffles.

The controller circuit includes a rectifier circuit for converting a 12 volt-ac source circuit to a 12 volt-dc circuit for supplying electrical power to the arrays of the plurality of different colored LED bulbs. A transformer circuit for reducing a voltage from a 110 volt-ac source circuit to a 12 volts-ac circuit is optionally included where the power source is a 110 volt-ac circuit. The 12 volts-ac circuit is in electrically operative communication with the rectifier circuit.

In a typical application of this water fountain embodiment, the predetermined arrays of the plurality of multi-colored LED bulbs may include an array of three red LED bulbs, an array of two green LED bulbs, and an array of two blue LED bulbs, each of the arrays being electrically operative connected to each activate at predetermined sequences and at predetermined time intervals.

The invention is adapted such that it can be applied to beautify the waterfall effects and water fountain effects of swimming pools, spas, fountain pools, and similar settings, by providing brilliant different colored lights to the flowing water stream.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
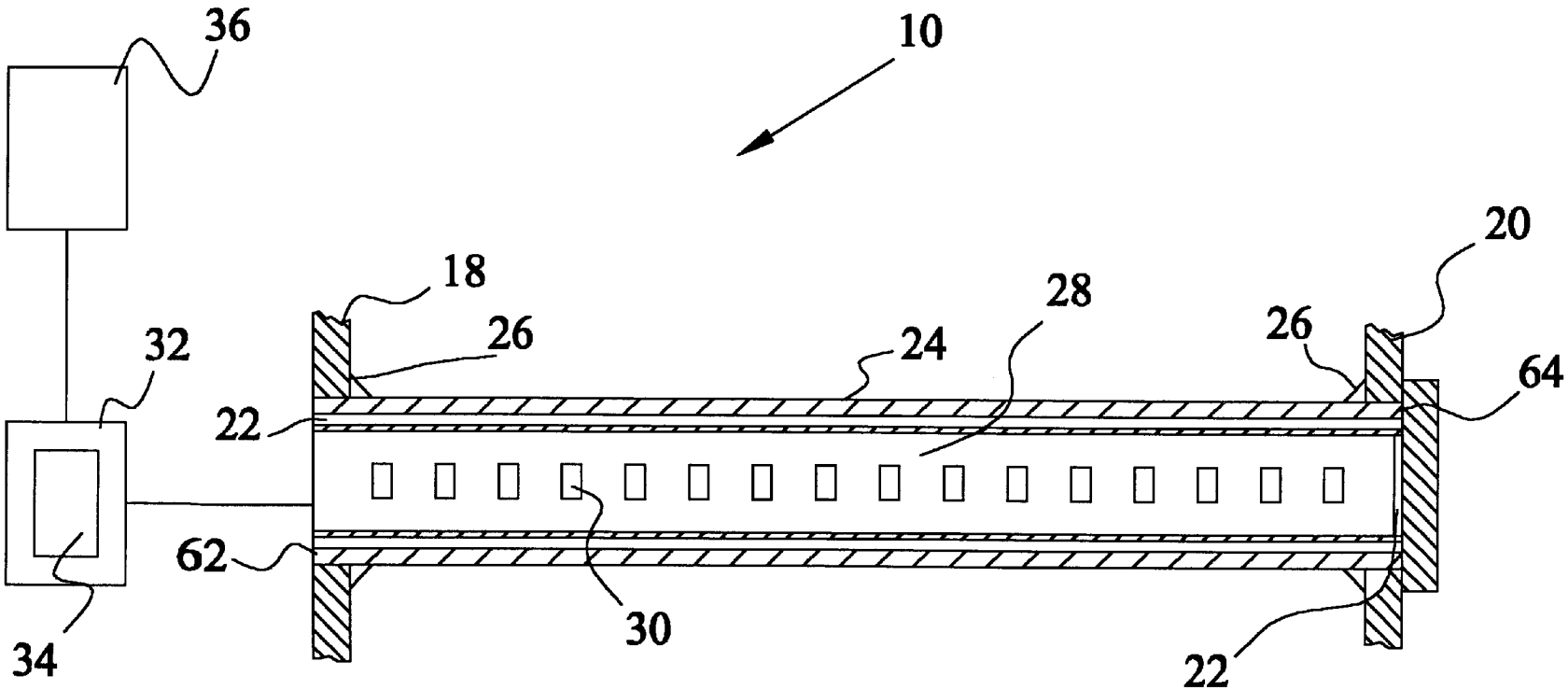
FIG. 1 is a schematic view of one embodiment of the invention in a waterfall application.
Figure 3:
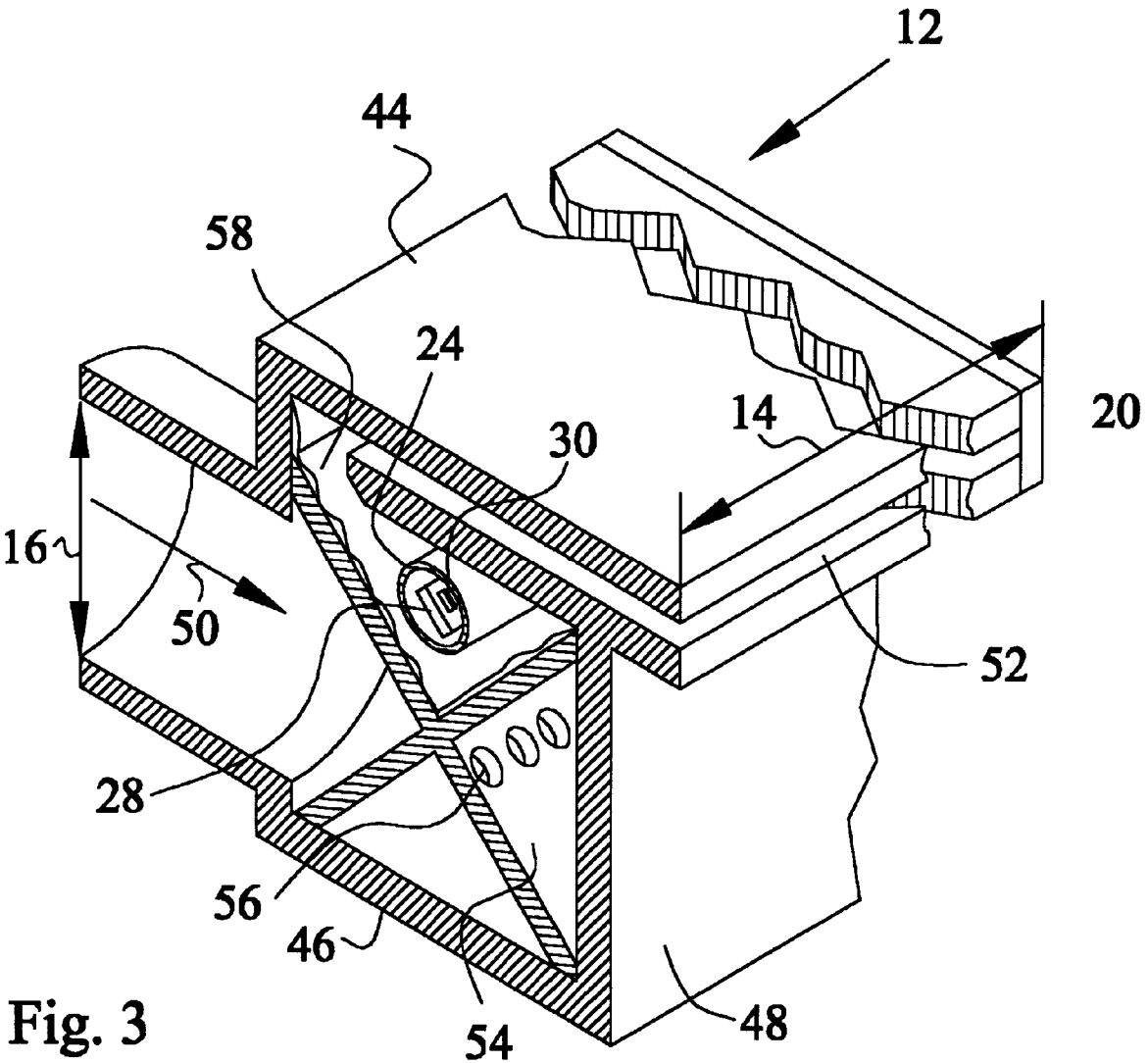
FIG. 3 is a cross-sectional view of one embodiment of a waterfall vessel with the LED bulbs and circuit board wafer strip disposed in a clear tube.

Referring now to the drawings, in particular FIG. 1, the invention which is an apparatus for creating a multi-colored illuminated waterfall and is depicted generally as 10, comprises means 12 for changing a columnar flow of incoming water from a water inlet pipe 50 into a shallow stream of water at outlet opening 52, FIG. 3, the shallow stream of water having a predetermined breadth 14 greater than the breadth 16 of the inlet pipe 50 so that a waterfall effect is created, wherein the means 12 has a first end 18 and a second end 20, each end 18,20 having apertures 22 therethrough axially aligned with each other.

A clear tube 24 having a first end 62 and a second end 64 is longitudinally disposed between the aperture 22 at the first end 18 of means 12 and the aperture 22 at the second end 20 of means 12 for creating the waterfall effect. The first and second ends 62,64 of said clear tube 24 are in leak tight engagement at said first end aperture 22 and second end aperture 22 respectively. The leak tight engagement is generally done by epoxy bonding or otherwise cementing the tube 24 into apertures 22. The tube 24 is preferably made from a clear material such as Lexan™, plexiglass or other similar durable material. Means 12 is typically made from a molded polymeric material, fiber-reinforced polymeric material or other similar non-corrosive materials. In addition, means 12 may be made from stainless steel.

An LED light emitting circuit board wafer strip 28, upon which is mounted a plurality of different colored LED bulbs 30 in a predetermined spaced-apart arrangement, is disposed through aperture 22 at the first end 18 and inside the clear tube 24. A controller circuit 32 is in electrically operative communication with the predetermined arrays of the plurality of different colored LED bulbs 30 wherein the predetermine arrays of the plurality of different colored LED bulbs 30 activate at predetermined sequences and at predetermined time intervals.

As depicted in FIG. 3, the means 12 for creating the waterfall effect is a waterfall vessel 12 having a top wall 44, a bottom wall 46, a front wall 48 and the first and second ends 18,20, an inlet opening 50 for incoming columnar water flow into the vessel 12, an outlet opening 52 for water flow exiting in the form of a waterfall, and at least one longitudinally baffle 54 disposed in the vessel 12 for suppressing turbulence of the incoming columnar water flow. It is recommended that multiple or a plurality of longitudinal baffles 54 or arrangement of baffles 54 be included or disposed in vessel 12 construction. These baffles 54 may interconnect or intersect with each other as depicted in one arrangement in FIG. 3.

In the embodiment of a vessel 12 depicted in FIG. 3 where the longitudinal baffles 54 intersect with each other, then a plurality of apertures for directing the flow of water from the inlet opening, through the baffles, to the outlet opening and for suppressing water turbulence, is included. Further, it has been found that the intensity of the light can be enhanced by adding means 58 for reflecting and enhancing emitted light, the means 58 being a reflective film or metallic foil adhesively secured to portions of inside surfaces of the at least one baffle, front wall, back wall, and bottom wall or any inside vessel surface juxtaposed the clear tube.

As shown in FIG. 1, the controller circuit 32 includes a rectifier circuit 34 for converting a 12 volt-ac source circuit to a 12 volt-dc circuit for supplying electrical power to the arrays of the plurality of different colored LED bulbs. Although it is not necessary, it is anticipated that the rectifier circuit 34 will be built into the same circuit board as the controller circuit 32. The controller circuit 32 and rectifier 34 are powered from a 12 volt-ac power source 36 as typically found near swimming pools.

Figure 2:
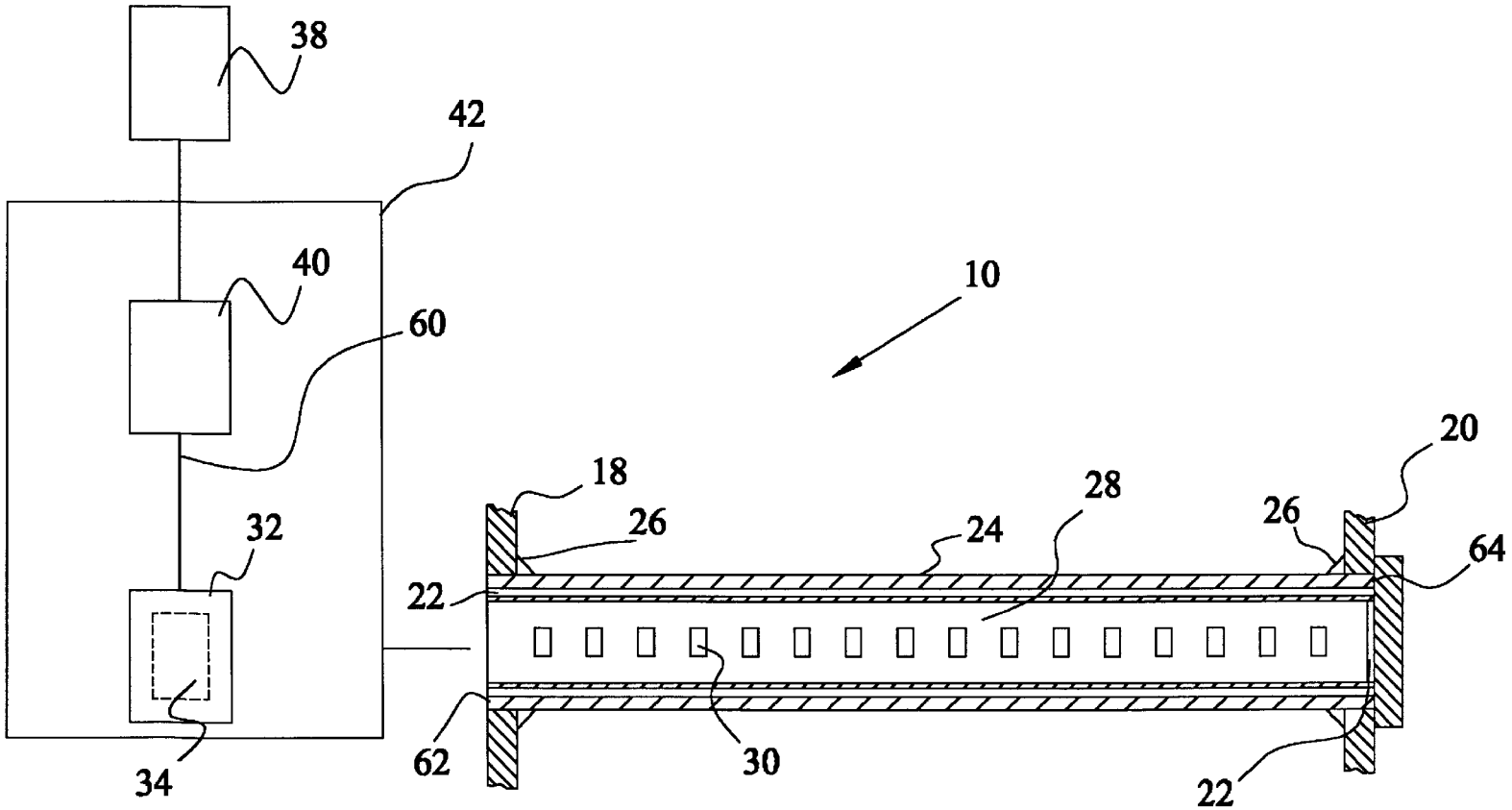
FIG. 2 is a schematic view of the embodiment of FIG. 1 with the addition of a transformer circuit.

In unusual situations where the source of power available near a pool is not 12 volt-ac but rather 110 volt-ac, then a transformer circuit 40, as depicted in FIG. 2, is provided for reducing a voltage from a 110 volt-ac source circuit 38 to a 12 volts-ac circuit 60 with the 12 volts-ac circuit 60 being in electrically operative communication with the rectifier circuit 34. It is anticipated that the combined controller circuit 32 and rectifier circuit 34 would be housed in a remote weatherproof housing 42. Similarly, these circuits 32,34 could also be housed together with a transformer circuit 40 in a remote weatherproof housing 42.

The controller circuit would be pre-wired and preset at the manufacturer or assembler with necessary switches and resistors such that selected arrays of LED bulbs 30 would light in a predetermined sequence and for a predetermined time interval. Typically red, blue and green LED bulbs 30 are used and electrically connected in such a manner as to provide a balanced brilliancy of the lighting projected within the water stream exiting the waterfall vessel 12. For example, where red LED bulbs typically do not provide as brilliant a light as blue and green LED bulbs, then either more red LED bulbs are provided than the number of green and blue LED bulbs or the circuitry is adapted to balance the brilliance of these lights. One method may be to have additional red LED bulbs. For example, a circuit board wafer strip 28 may contain clusters of red, blue and green LED bulbs 30 in the ratio of 1:1:1, for example, 16 red, 16 blue, and 16 green LED bulbs, or optionally in the ratio of 5:3:3, for example, 5 red, 3 blue and 3 green LED bulbs. Other combinations and colors are anticipated depending on the lighting effect desired for the waterfall.

In another embodiment of the present invention, which is depicted in FIGS. 4, 5, 6 and 6*a*, and which is generally depicted as 100, an apparatus for creating a multi-colored illuminated water fountain is presented. The invention 100 comprises means 112 for changing a columnar flow of incoming water from a water inlet pipe into a laminar stream of water to create a water fountain effect, the means 112 including a tee 112*a* in fluid communication with the water inlet pipe 106. The tee 112*a* has a first branch 146, a second branch 148 and a third branch 150. Means 112 is preferably made of PVC material although it could be made from stainless steel, brass material or other non-corrosive materials. Inlet pipe 106 is typically a connection, generally a union connection, for a water line plumbed to a utility box 104 which is typically roughed into the wall of a pool or fountain. The utility box 104 is also generally made of a polymeric material such as PVC or fiber-reinforced polymers for mortaring into the fountain wall before the tile is placed around it. A second conduit or wireway 108 is generally provided in the utility box 104 for providing electrical power to the inventive embodiment described herein.

The tee 112*a* first branch 146 further includes a clear lens 120 disposed inside the first branch, the lens 120 being in a leak tight engagement with an inside surface of said first branch 146. The lens is preferably a clear non-breakable material such as a crystal or LEXAN™ or plexiglass and is sealed peripherally inside first branch 146 at 122.

Figure 4:
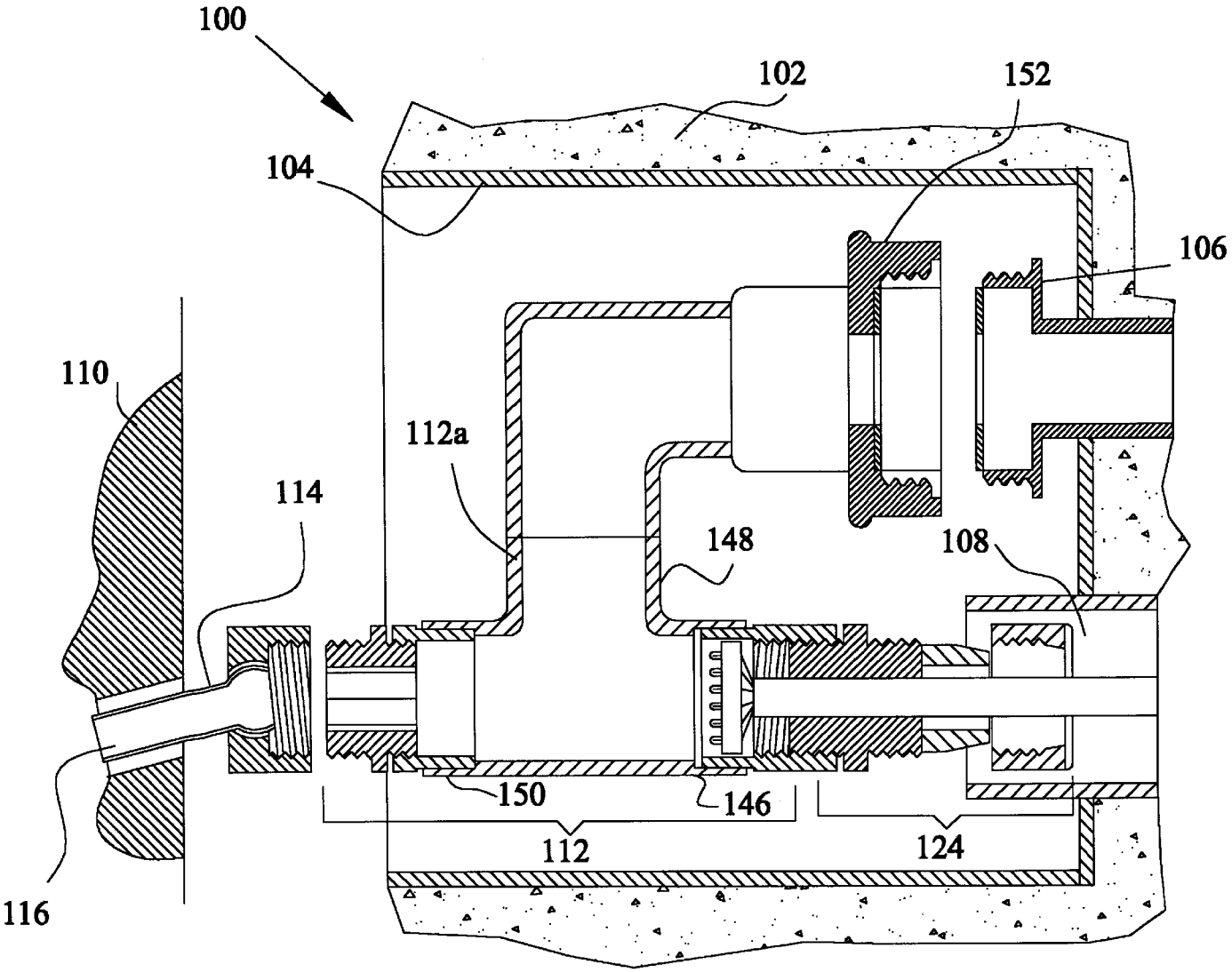
FIG. 4 is a cross-sectional view of another embodiment of the present invention in a water fountain application.

The second branch 148 is in fluid communication with the water inlet pipe 106 and the third branch 150 is in fluid communication with a tubular directing means 114 for creating the laminar stream of water and for directing the water flow in a desired direction as indicated by the arrow in FIG. 4 through an opening 116 in an ornamental facade 110. The ornamental facade 110 is typically a facial caricatures of a lion or similar animal wherein the opening 116 is through an open mouth of the animal, or it could represent other figures, including human anatomical figures.

An LED light emitting circuit board wafer strip 130 including a plurality of different colored LED bulbs 128 in a predetermined spaced-apart arrangement, the circuit board wafer strip 130 being disposed juxtaposed the clear lens 120 inside the first branch 146 of the tee 112*a*.

Figure 5:
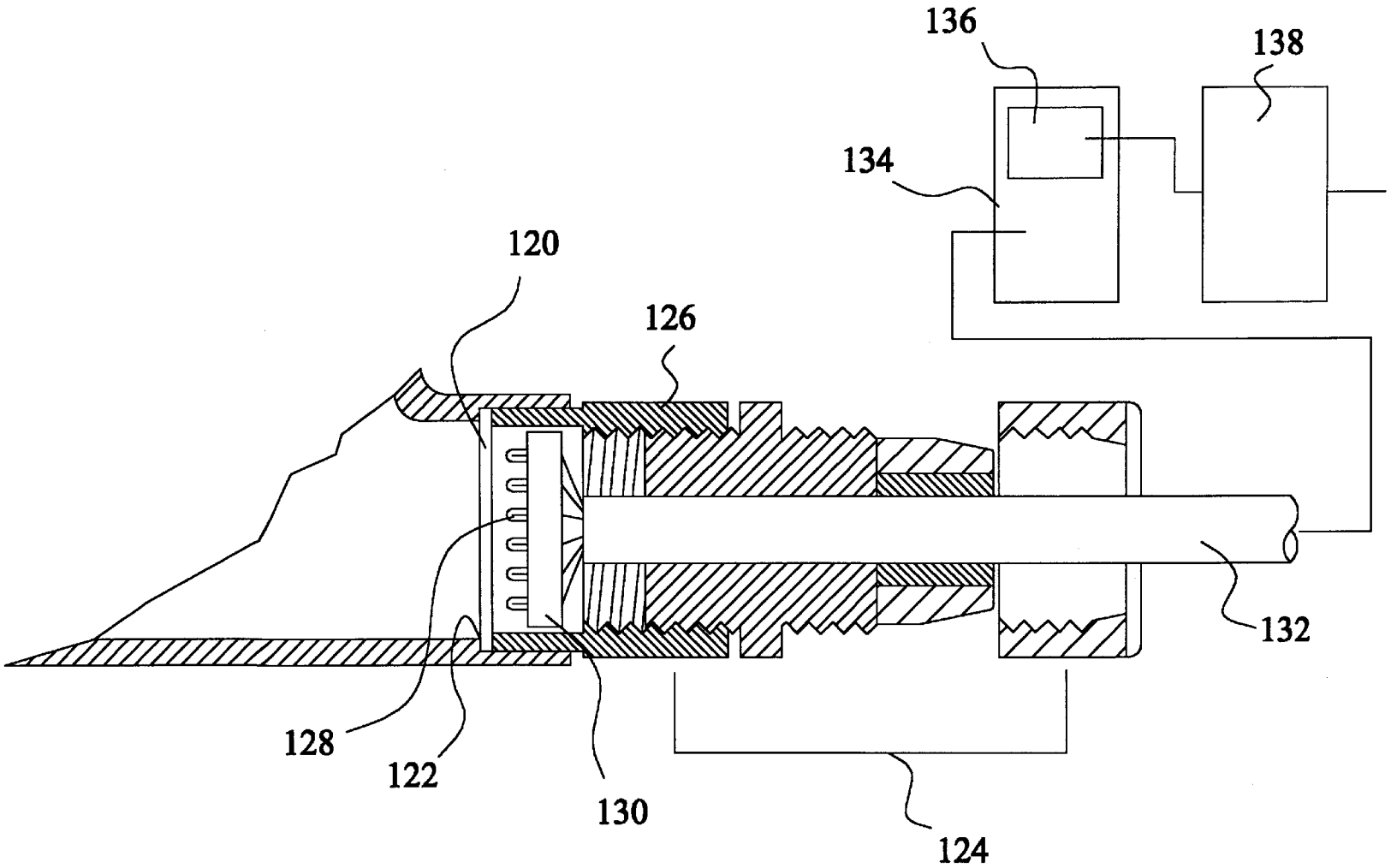
FIG. 5 is a partial cross-sectional view of the LED bulbs and circuitry for the embodiment of FIG. 4.

A controller circuit 134 is included which is in electrically operative communication with predetermined arrays of the plurality of different colored LED bulbs 128 such that the predetermine arrays of the plurality of different colored LED bulbs 128 activate at predetermined sequences and at predetermined time intervals. As depicted in FIG. 5, the LED bulbs 128 are disposed in a generally normal orientation to the lens and the wiring in an insulated sleeve to the strip 130 is secured in placed with adapter 126 and wire bushing connector 124.

Figure 6A:
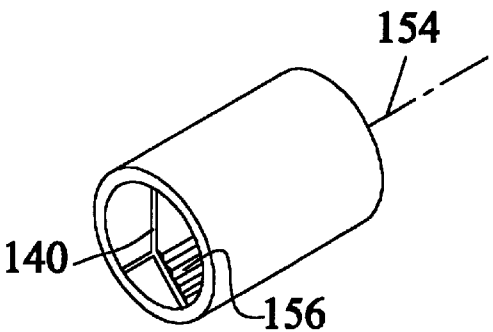
FIG. 6*a* is an isometric view of the baffle depicted in FIG. 6.
Figure 6:
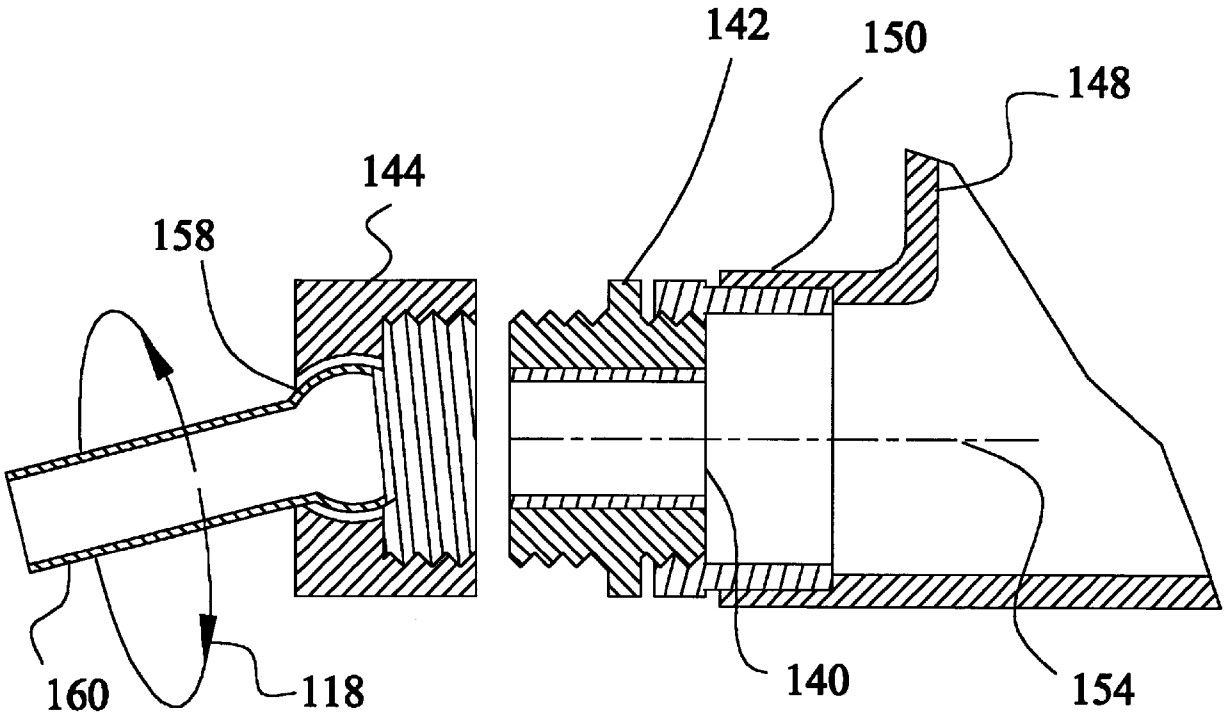
FIG. 6 is a cross-sectional view of the tubular directing means connected to the third branch of the tee depicted in FIG. 4.

As depicted in FIG. 6, the tubular directing means 114 for creating the laminar stream of water includes a plurality of longitudinal baffles 140 disposed within the third branch 150 of the tee 112*a*. The baffles 140 extend radially from a central axis 154 of the third branch 150 of the tee 112*a* and interconnect with each other at the central axis 154. The baffles provide suppression of the turbulence of the incoming columnar flow of water. FIG. 6*a* depicts an isometric view of a preferred arrangement for baffles 140 wherein three baffles form a y-shape. Similarly, an X-shape may be used. Baffles 140 is generally secured within the third branch 150 of tee 112*a* with an adapter and bushing combination, 142 and 144 respectively. As with the previously discussed embodiment, lighting may be enhanced by optionally including means 156 for reflecting and enhancing emitted light, the means 156 being a reflective film adhesively secured to portions of inside surfaces of the plurality of longitudinal baffles 140.

The controller circuit 134 includes a rectifier circuit 136 for converting a 12 volt-ac source to 12 volt-dc for supplying electrical power to the arrays of the plurality of different colored LED bulbs 128. Further, as discussed for the first embodiment of the present invention, in circumstances where only 110 volt-ac power is available, a transformer circuit 138 for reducing a voltage from the 110 volt-ac source to 12 volts-ac is provided with the 12 volts-ac output being in electrically operative communication with the rectifier circuit 136. It is anticipated that the controller circuit 134 and rectifier circuit 136 will be housed in weatherproof utility box if mounted exposed to the elements, such as 42 depicted in FIG. 2. Similarly, transformer 138 can also be included within a protective housing 42.

In a practical application of the present invention, it is anticipated that the predetermined arrays of the plurality of multi-colored LED bulbs 128 includes an array of three red LED bulbs, an array of two green LED bulbs, and an array of two blue LED bulbs, wherein each of the arrays are electrically operative connected to each activate at predetermined sequences and at predetermined time intervals.

As shown in FIG. 6, the tubular directing means 114 includes a discharge tube 160 integral to a ball-type swivel connection 158 at one end of the discharge tube 160 for mechanically connecting the discharge tube 160 to the third branch 150 of the tee 112*a*. The swivel connection 158 allows the discharge tube 160 to be directed or swiveled in a radial 360 degree pattern, as shown by the arrows at 118.

As previously described for the waterfall embodiment, the controller circuit 130 would be pre-wired and preset at the manufacturer or assembler with necessary switches and resistors such that selected arrays of LED bulbs 128 would light in a predetermined sequence and for a predetermined time interval.

Figure 7A:
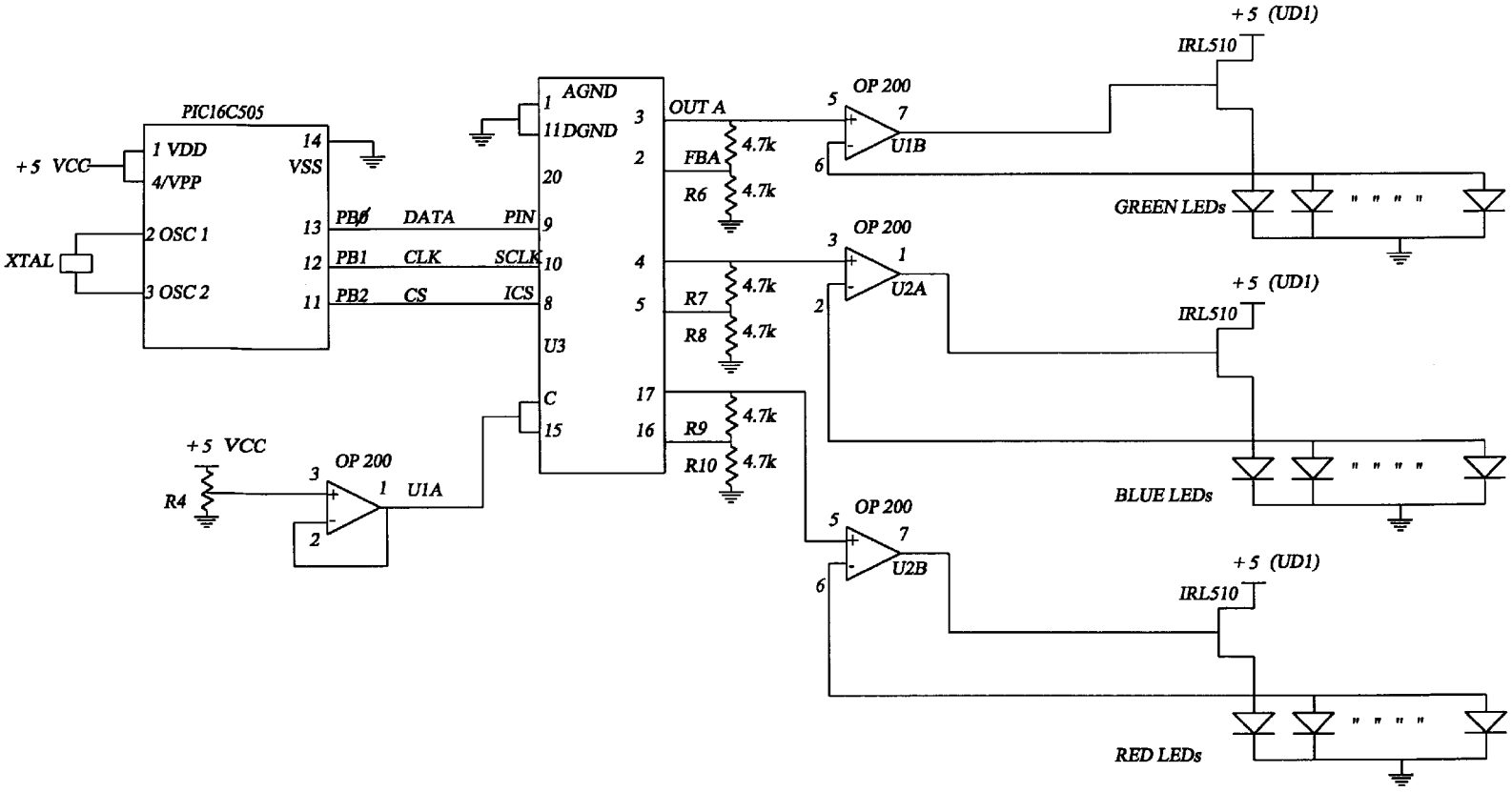
FIG. 7*a* is a typical schematic wiring diagram for the controller circuit in the embodiments of FIGS. 1 and 4.
Figure 7B:
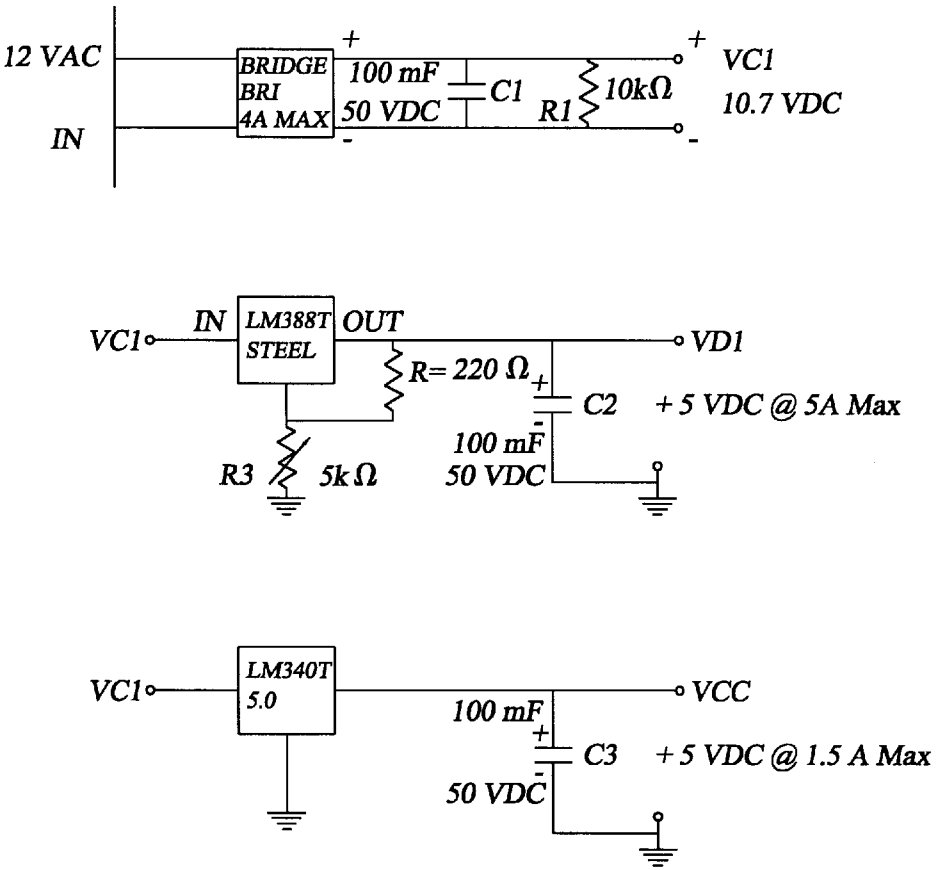
FIG. 7*b* is a typical schematic wiring diagram for an a–c rectifier circuit, an LED supply circuit and a logic supply circuit in the embodiments of FIGS. 1 and 4.

FIGS. 7*a* and 7*b* are typical wiring schematic diagrams depicting the controller circuitry, an a–c rectification circuit and an LED supply and logic supply circuit for the embodiments depicted in FIGS. 1–6*a*.

Figure 7C:
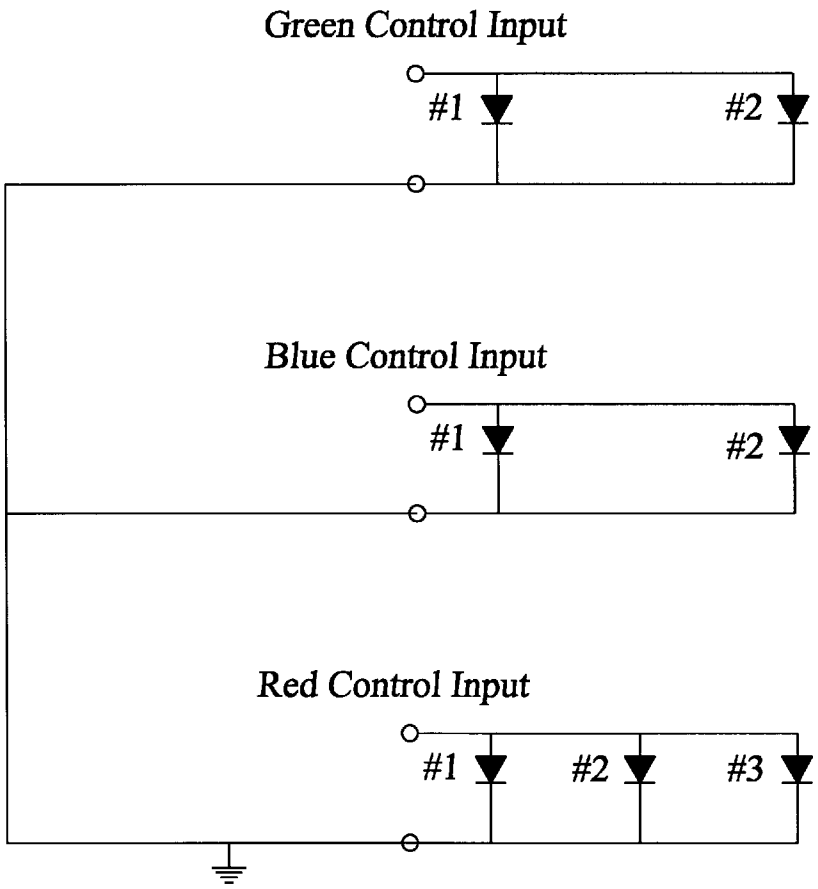
FIG. 7*c* is a typical schematic wiring diagram for a preferable parallel arrangement of LED bulbs for the water fountain application.

FIG. 7*c* is a typical wiring schematic diagram for a preferable parallel arrangement of LED bulbs for the water fountain application.

As seen from the foregoing description, the present invention satisfies a continuing need to provide an innovative device for lighting and beautifying waterfalls and water fountains using low energy LED lighting technology, particularly in the pool and water fountain industries.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for creating a multi-colored illuminated waterfall comprising:

means for changing a columnar flow of incoming water from a water inlet pipe into a shallow stream of water having a predetermined breadth greater than the breadth of the inlet pipe so that a waterfall effect is created, wherein said means has a first end and a second end, each end having apertures therethrough axially aligned with each other;

a clear tube having a first end and a second end, the tube being longitudinally disposed between said first end aperture and second end aperture of the means for creating the waterfall effect, the first and second ends of said tube being in leak tight engagement at said first end aperture and second end aperture respectively;

an LED light emitting circuit board wafer strip including a plurality of different colored LED bulbs in a predetermined spaced-apart arrangement, the circuit board wafer strip being disposed through the first end aperture and inside the clear tube; and a controller circuit in electrically operative communication with predetermined arrays of the plurality of different colored LED bulbs wherein the predetermine arrays of the plurality of different colored LED bulbs activate at predetermined sequences and at predetermined time intervals.

2. The apparatus for creating a multi-colored illuminated waterfall according to claim 1 wherein the means for creating the waterfall effect comprises:

a waterfall vessel having a top wall, a bottom wall, a front wall and the first and second ends;

an inlet opening for incoming columnar water flow into the vessel;

an outlet opening for water flow exiting in the form of a waterfall; and at least one baffle disposed in the vessel for suppressing turbulence of the incoming columnar water flow.

3. The apparatus for creating a multi-colored illuminated waterfall according to claim 1 wherein the means for creating the waterfall effect comprises:

a waterfall vessel having a top wall, a bottom wall, a front wall and the first and second ends;

an inlet opening for incoming columnar water flow into the vessel;

an outlet opening for water flow exiting in the form of a waterfall; and a plurality of longitudinally disposed baffles in the vessel for suppressing turbulence of the incoming columnar water flow.

4. The apparatus for creating a multi-colored illuminated waterfall according to claim 3 wherein the plurality of baffles interconnect with each other, said baffles interconnect with each other, the baffles further comprising a plurality of apertures for directing the flow of water from the inlet opening, through the baffles, to the outlet opening and for suppressing water turbulence.

5. The apparatus for creating a multi-colored illuminated waterfall according to claim 2 further comprising means for reflecting and enhancing emitted light, the means including a reflective film adhesively secured to portions of inside surfaces of the at least one baffle, front wall, back wall, and bottom wall juxtaposed to the clear tube.

6. The apparatus for creating a multi-colored illuminated waterfall according to claim 3 further comprising means for reflecting and enhancing emitted light, the means including a reflective film adhesively secured to portions of inside surfaces of the plurality of baffles, front wall, back wall, and bottom wall juxtaposed to the clear tube.

7. The apparatus for creating a multi-colored illuminated waterfall according to claim 1, wherein the controller circuit includes a rectifier circuit for converting a 12 volt-ac source circuit to a 12 volt-dc circuit for supplying electrical power to the arrays of the plurality of different colored LED bulbs.

8. The apparatus for creating a multi-colored illuminated waterfall according to claim 7, further comprising a transformer circuit for reducing a voltage from a 110 volt-ac source circuit to a 12 volts-ac circuit, said 12 volts-ac circuit being in electrically operative communication with the rectifier circuit.

9. An apparatus for creating a multi-colored illuminated water fountain comprising:

means for changing a columnar flow of incoming water from a water inlet pipe into a laminar stream of water to create a water fountain effect, the means including a tee in fluid communication with the water inlet pipe, the tee having a first branch, a second branch and a third branch;

the tee first branch further including a clear lens disposed inside the first branch, the lens being in a leak tight engagement with an inside surface of said first branch;

the second branch being in fluid communication with the water inlet pipe and the third branch being in fluid communication with a tubular directing means for creating the laminar stream of water and for directing the water flow in a desired direction through an opening in a facade;

an LED light emitting circuit board wafer strip including a plurality of different colored LED bulbs in a predetermined spaced-apart arrangement, the circuit board wafer strip being disposed juxtaposed the clear lens inside the first branch of the tee; and a controller circuit in electrically operative communication with predetermined arrays of the plurality of different colored LED bulbs wherein the predetermine arrays of the plurality of different colored LED bulbs activate at predetermined sequences and at predetermined time intervals.

10. The apparatus for creating a multi-colored illuminated water fountain according to claim 9 wherein the tubular directing means for creating the laminar stream of water includes a plurality of longitudinal baffles disposed within the third branch of the tee, the baffles extending radially from a central axis of the third branch of the tee and interconnecting with each other at the central axis, the baffles for suppressing turbulence of the incoming columnar flow of water.

11. The apparatus for creating a multi-colored illuminated water fountain according to claim 10 further comprising means for reflecting and enhancing emitted light, the means including a reflective film adhesively secured to portions of inside surfaces of the plurality of longitudinal baffles.

12. The apparatus for creating a multi-colored illuminated water fountain according to claim 9, wherein the controller circuit includes a rectifier circuit for converting a 12 volt-ac source to 12 volt-dc for supplying electrical power to the arrays of the plurality of different colored LED bulbs.

13. The apparatus for creating a multi-colored illuminated water fountain according to claim 12, further comprising a transformer circuit for reducing a voltage from a 110 volt-ac source to 12 volts-ac, said 12 volts-ac being in electrically operative communication with the rectifier circuit.

14. The apparatus for creating a multi-colored illuminated water fountain according to claim 9, wherein the predetermined arrays of the plurality of multi-colored LED bulbs includes an array of two red LED bulbs, an array of two green LED bulbs, and an array of two blue LED bulbs, each of the arrays being electrically operative connected to each activate at predetermined sequences and at predetermined time intervals.

15. The apparatus for creating a multi-colored illuminated water fountain according to claim 14, wherein the arrays of red, green and blue LED bulbs are electrically connected so as to provide a substantially equalized light intensity between each of the arrays of the red, green and blue LED bulbs.

16. The apparatus for creating a multi-colored illuminated water fountain according to claim 9, wherein the tubular directing means includes a discharge tube with a ball-type swivel connection at one end of the discharge tube for mechanically connecting the discharge tube to the third branch of the tee.

* * * * *